US010632771B2

(12) United States Patent
Kanno

(10) Patent No.: US 10,632,771 B2
(45) Date of Patent: Apr. 28, 2020

(54) IMAGE FORMING APPARATUS, BELT DRIVING DEVICE, AND BELT DRIVING DEVICE CONTROL METHOD

(71) Applicant: KONICA MINOLTA, INC., Chiyoda-ku, Tokyo (JP)

(72) Inventor: Ryoichiro Kanno, Sagamihara (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/034,547

(22) Filed: Jul. 13, 2018

(65) Prior Publication Data

US 2019/0054749 A1 Feb. 21, 2019

(30) Foreign Application Priority Data

Aug. 18, 2017 (JP) ..... 2017-157757

(51) Int. Cl.

| | |
|---|---|
| ***B41J 15/16*** | (2006.01) |
| ***B41J 11/00*** | (2006.01) |
| ***G03G 15/16*** | (2006.01) |
| *G03G 15/00* | (2006.01) |

(52) U.S. Cl.

CPC ..... *B41J 15/16* (2013.01); *B41J 11/007* (2013.01); *G03G 15/1615* (2013.01); *G03G 15/55* (2013.01)

(58) Field of Classification Search

CPC ..... B41J 15/16; B41J 11/007

See application file for complete search history.

(56) References Cited

U.S. PATENT DOCUMENTS

2008/0106565 A1* 5/2008 Miyazawa ..... B41J 11/006 347/16
2014/0192108 A1* 7/2014 Horaguchi ..... B41J 11/007 347/16
2018/0037428 A1* 2/2018 Ito ..... B65G 23/44

FOREIGN PATENT DOCUMENTS

JP 2011-158614 A 8/2011

* cited by examiner

*Primary Examiner* — Jason S Uhlenhake
(74) *Attorney, Agent, or Firm* — Buchanan Ingersoll & Rooney PC

(57) ABSTRACT

In an image forming apparatus, in which a belt driving device, provided in an image forming part, has: plural rollers including a driving roller; an endless belt; a driver, with one roller as a tension control roller to control tension applied to the endless belt, that moves the tension control roller in a vertical direction to an axis of another roller; a position detector that detects the position of the tension control roller; a pressure detector that detects pressure added with the endless belt to the tension control roller; and a controller that controls movement of the tension control roller. To set the tension applied to the endless belt as a predetermined value, the controller controls the driver to bring the detected pressure closer to a target pressure to be added to the tension control roller in the detected position of the tension control roller.

19 Claims, 5 Drawing Sheets

IMAGE FORMING APPARATUS, BELT DRIVING DEVICE, AND BELT DRIVING DEVICE CONTROL METHOD

CROSS-REFERENCE TO RELATED APPLICATIONS

The entire disclosure of Japanese Patent Application No. 2017-157757, filed on Aug. 18, 2017, is incorporated herein by reference in its entirety.

BACKGROUND

Technological Field

The present invention relates to an image forming apparatus, a belt driving device and a belt driving device control method.

Description of the Related Art

An image forming apparatus has a belt driving devices such as a conveyer belt to convey a recording medium, and further an intermediate transfer belt to hold an image to be transferred to the recording medium. These belt driving devices have a structure in which an endless belt is stretched around e.g. a driving roller, a driven roller, and a tension adding roller. It is known that in the belt driving device having this structure, belt running becomes unstable due to expansion and contraction of the belt accompanying temperature change. Accordingly, a structure to change tension added to the belt by moving the position of the driven roller or the tension adding roller in accordance with belt temperature detected with a temperature detector is proposed (see the following Patent Literature 1).

CITATION LIST

Patent Literature

[Patent Literature 1] Japanese Unexamined Patent Application Publication No. 2011-158614

SUMMARY

However, in the image forming apparatus, the performance of belt running in the belt driving device has a significant impact on an ink image formed on the recording medium or the precision of formation of an image held on the intermediate transfer belt. Accordingly, further improvement of the running performance of the belt is required in the belt driving device.

The present invention has an object to provide an image forming apparatus capable of high-precision image forming by further improving the running performance of an endless belt, and further to provide a belt driving device and a belt driving device control method capable of further improving the running performance of the endless belt.

To achieve at least one of the above objects, according to an aspect of the present invention, an image forming apparatus reflecting one aspect of the present invention is provided in which an image forming part is provided with a belt driving device. The belt driving device includes: a plurality of rollers including a driving roller; an endless belt stretched around the plurality of rollers; a driver, with one of the plurality of rollers as a tension control roller to control tension applied to the endless belt, that moves a position of the tension control roller in a vertical direction to an axis of another roller; a position detector that detects the position of the tension control roller; a pressure detector that detects pressure applied with the endless belt to the tension control roller; and a controller that controls movement of the tension control roller with the driver. To set the tension applied to the endless belt as a predetermined value, the controller controls the driver to bring the pressure detected with the pressure detector closer to a target pressure to be added to the tension control roller in the position of the tension control roller detected with the position detector.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinbelow, an image forming apparatus, a belt driving device provided in the image forming apparatus, and a belt driving device control method, to which the present invention is applied, will be described in due course. Note that in the following embodiment, an ink-jet image forming apparatus will be given as the image forming apparatus, however, the image forming apparatus according to the present invention is widely applicable to structures having a belt driving device. Further, the belt driving device to be described in the embodiment is not limited to the device provided in the image forming apparatus, but is widely applicable to belt driving devices required to have high running performance with respect to an endless belt.

<<Image Forming Apparatus>>

Figure 1:
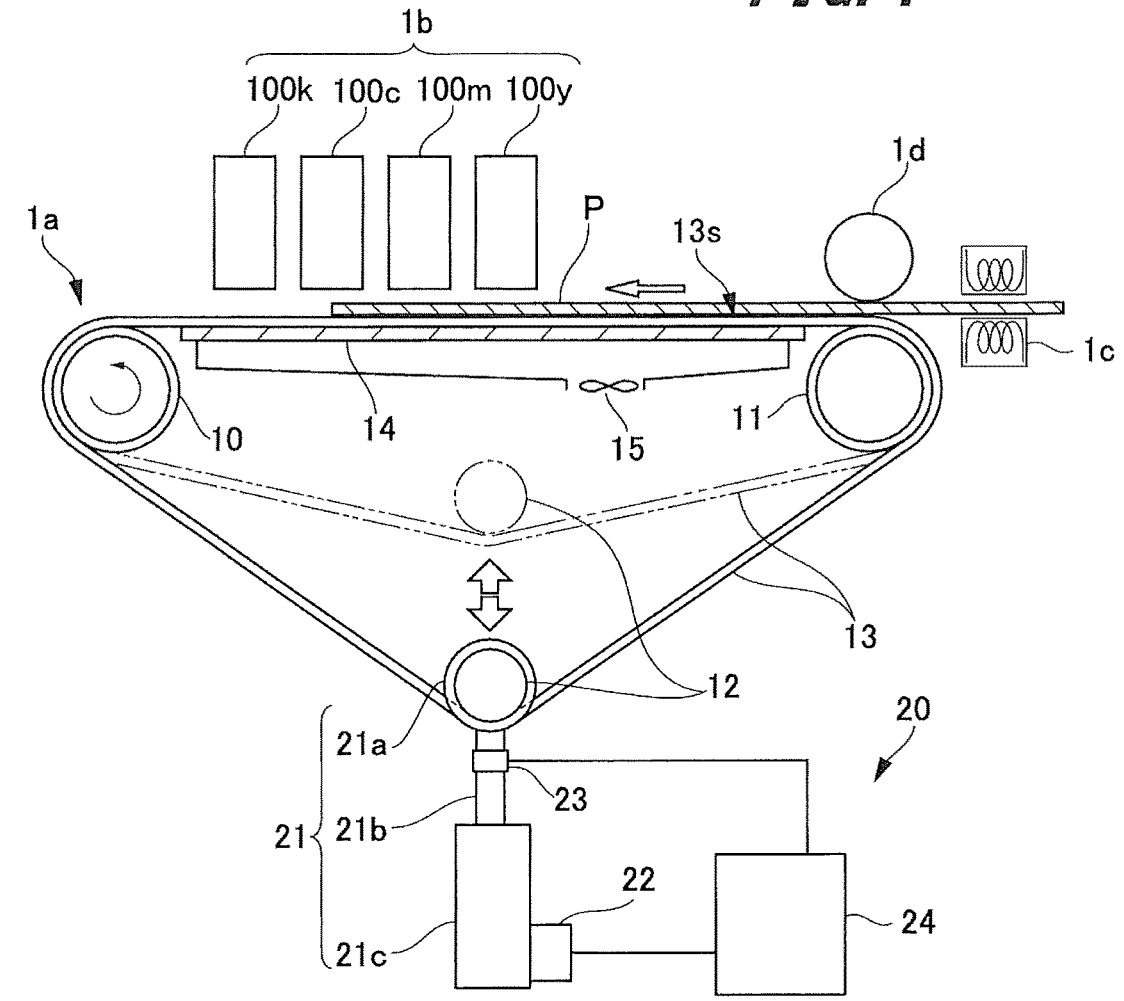
FIG. 1 is a main part block diagram of an image forming apparatus according to an embodiment.

FIG. 1 is a main part block diagram of the image forming apparatus according to an embodiment, showing an image forming part in the ink-jet image forming apparatus viewed from a side direction. As shown in this figure, an ink-jet image forming apparatus 1 has a belt driving device 1*a*, an ink supply device 1*b*, a heater 1*c*, and a pressing roller 1*d*.

In this configuration, the belt driving device 1*a* is used for conveyance of a recording medium P in a predetermined direction. As the recording medium P, in addition to a normal paper sheet, a cardboard, a corrugated paper sheet, further, sheets formed of resin material, cloth material and the like, are widely used.

The belt driving device 1*a* has a driving roller 10, a driven roller 11, a tension control roller 12, and an endless belt 13 stretched around these rollers. The belt driving device 1*a* rotates the endless belt 13 by rotation of the driving roller 10. With this configuration, with an outer peripheral surface of the endless belt 13 as a placement surface 13*s* for the recording medium P, the recording medium P held on the placement surface 13*s* is conveyed in a rotating direction of the endless belt 13. This belt driving device 1*a* has a driving mechanism 20 characteristic of the present embodiment. The configurations of the belt driving device 1*a* and the driving mechanism 20 will be described in detail hereinafter.

The ink supply device 1*b* is used for supplying ink to the recording medium P conveyed with the belt driving device 1*a*. The ink supply device 1*b* has a structure where ink heads to supply respective color inks are provided along a conveyance direction of the recording medium P conveyed with the belt driving device 1*a*. As an example, a configuration where a yellow ink head 100*y*, a magenta ink head 100*m*, a cyan ink head 100*c*, and a black ink head 100*k* are provided in order along the conveyance direction of the recording medium P is shown, however, the order of the ink heads is not limited to this order.

The heater 1*c* is used for heating the recording medium P, supplied from an unshown medium supply part to the belt driving device 1*a*, such that the recording medium P has a uniform temperature. Although detailed illustration is omitted here, the heater 1*c* has a heating roller to heat the recording medium P supplied from the medium supply part and send the recording medium P to the belt driving device 1*a* side, and a heating chamber to uniform the temperature of the recording medium P, heated with the heating roller, in front of the belt driving device 1*a*. Note that the heater 1*c* is not limited to this structure as long as it has a structure capable of heating and heat-retaining the recording medium P conveyed with the belt driving device 1*a*. As the heater 1*c* having this structure, e.g., a structure to heat the endless belt 13 to which the recording medium P is adsorbed, may be used.

The pressing roller 1*d* is used for holding the recording medium P sent from the heater 1*c* to the belt driving device 1*a* between the placement surface 13*s* of the belt driving device 1*a* and the pressing roller 1*d*, to tightly press the recording medium P against the belt driving device 1*a*. This pressing roller 1*d* may be any driven roller as long as it is provided oppositely to the placement surface 13*s* of the belt driving device 1*a* and rotated in accordance with movement of the recording medium P.

In the image forming apparatus 1 having the above-described configuration, the recording medium P supplied from the medium supply part is uniformly heated with the heater 1*c*, and sent to the belt driving device 1*a*. Further, the recording medium P sent to the belt driving device 1*a*, in a status where it is tightly pressed with the pressing roller 1*d* against the placement surface 13*s* of the belt driving device 1*a*, is conveyed in a predetermined direction. Then the respective color inks are sequentially supplied from the ink supply device 1*b* with respect to the recording medium P, in a status where it is conveyed with the belt driving device 1*a* in the predetermined direction, thus an image is formed on the recording medium P.

In this image forming apparatus 1, the endless belt 13 of the belt driving device 1*a* is expanded longer by contact with the recording medium P heated to a predetermined temperature. When the endless belt 13 is expanded longer, a skid or meandering easily occurs in running of the endless belt 13. To maintain the precision of the image formed on the recording medium P, it is necessary to maintain good running performance of the endless belt 13 without influence of expansion and contraction due to heating, thus to improve conveyance of the recording medium P with the belt driving device 1*a*. In this manner, the belt driving device 1*a* for conveyance of the recording medium P has a configuration as follows.

<<Belt Driving Device 1*a*>>

The belt driving device 1*a* has, in addition to the above-described driving roller 10, the driven roller 11, the tension control roller 12, and the endless belt 13, a supporting body 14 to support the endless belt 13 from the inner peripheral side, and a suction fan 15.

<Driving Roller 10>

In this configuration, the driving roller 10 is a roller which has an unshown driving motor and which freely rotates in a predetermined direction. The driving roller 10 is provided with a rotational speed measuring unit such as a rotary encoder. The rotational speed measured with the measuring unit is fed back to the driving motor, thus the rotational speed is freely controlled.

<Driven Roller 11>

The driven roller 11 is a roller provided in parallel to the driving roller 10 with an interval where the ink supply device 1*b* is provided, between the driving roller 10 and the driven roller 11. Further, the driven roller 11 holds the recording medium P between the pressing roller 1*d* and the driven roller 11. The driven roller 11 is rotatable in accordance with the rotating operation of the endless belt 13 by the rotation of the driving roller 10.

<Tension Control Roller 12>

The tension control roller 12 is a roller provided in approximately parallel to the driving roller 10 and the driven roller 11, between the driving roller 10 and the driven roller 11. The tension control roller 12 adds pressure from the inner peripheral side toward the outer peripheral side, to the endless belt 13. The tension control roller 12 is a driven roller, and also has a function as a steering roller to control meandering of the endless belt 13. This tension control roller 12 is provided with the same distance from the driving roller 10 and from the driven roller 11, as an example, however, the tension control roller 12 is not limited to this arrangement. Further, this tension control roller 12 is provided with the driving mechanism 20 to control the pressure added to the endless belt 13. The details of the driving mechanism 20 will be described hereinafter.

<Endless Belt 13>

The endless belt 13 is stretched around the driving roller 10, the driven roller 11, and the tension control roller 12. The endless belt 13 has plural through holes enabling passage of air between the outer peripheral surface as the placement surface 13*s* for the recording medium P and an inner peripheral surface. These through holes are provided in correspondence with a position where the recording medium P is placed in a width direction of the endless belt 13.

Further, this endless belt 13 is made of e.g. steel, however, it is not limited to this material. The endless belt 13 is expanded and contracted by temperature change. Accordingly, in the endless belt 13 which conveys the recording medium P heated to the predetermined temperature, upon continuous conveyance processing of the recording medium P, especially the length in the rotating direction is expanded longer when heated by contact with the recording medium P.

<Supporting Body 14>

The supporting body 14 is a plate member to support the endless belt 13, between the driving roller 10 and the driven roller 11, from the inner peripheral side. The supporting body 14 has plural through holes communicating with the through holes provided in the rotating endless belt 13, to enable passage of air. This supporting body 14 may be formed of porous material.

<Suction Fan 15>

The suction fan 15 is provided between the driving roller 10 and the driven roller 11 on the inner peripheral side of the endless belt 13 via the supporting body 14. The suction fan 15 sucks the air on the placement surface 13*s* side in the endless belt 13 via the through holes of the supporting body 14 and the through holes of the endless belt 13. The belt driving device 1*a* causes the recording medium P, supplied on the placement surface 13*s* of the endless belt 13, to be sucked to the placement surface 13*s* with the driving of this suction fan 15, between the driving roller 10 and the driven roller 11, and conveys the recording medium P in the sucked state in the rotating direction of the endless belt 13.

<Driving Mechanism 20 of Tension Control Roller 12>

Figure 2:
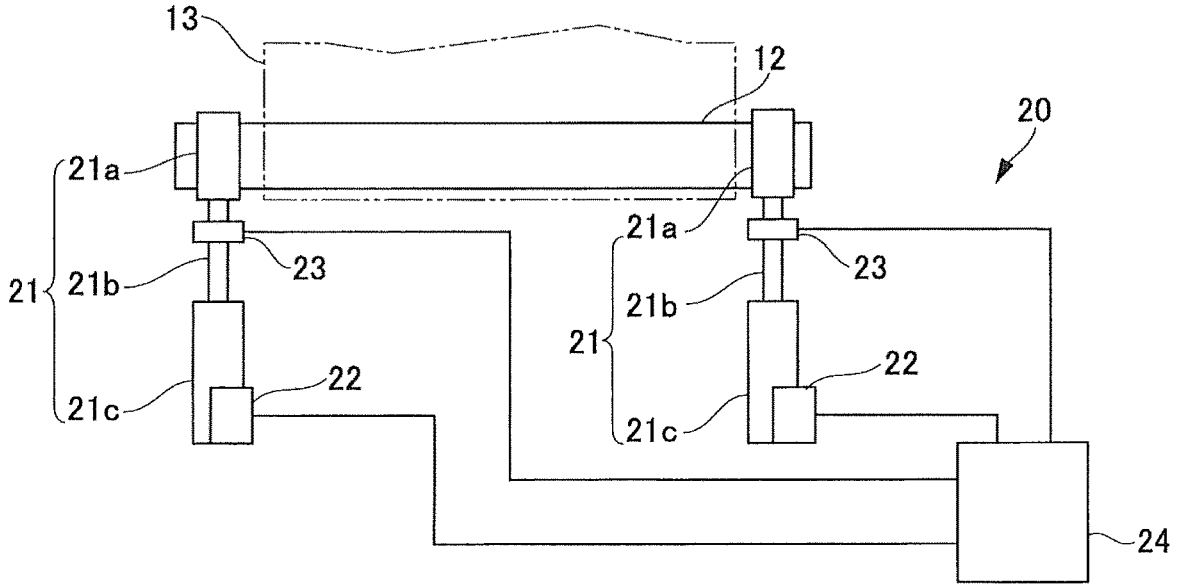
FIG. 2 is a main part block diagram of a belt driving device provided in the image forming apparatus according to the embodiment.
Figure 3:
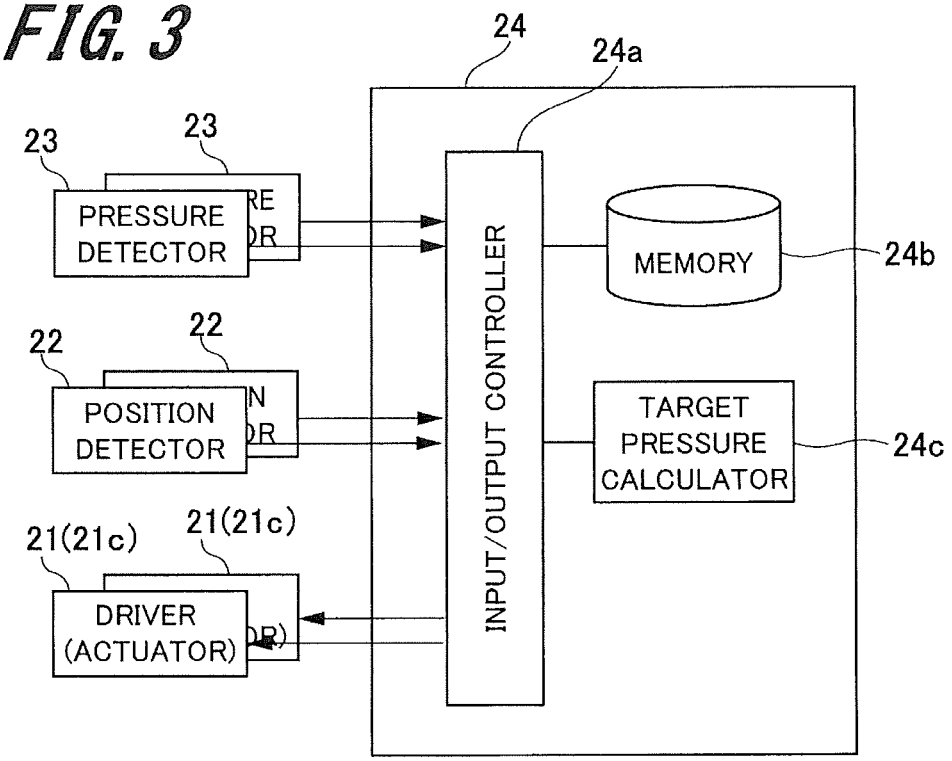
FIG. 3 is a functional block diagram of the belt driving device according to the embodiment.

FIG. 2 is a main part block diagram of the belt driving device 1*a* provided in the image forming apparatus according to the embodiment, showing the main parts of the belt driving device 1*a* shown in FIG. 1 viewed from a front direction. Further, FIG. 3 is a functional block diagram of the belt driving device according to the embodiment. Hereinbelow, the details of the driving mechanism 20 of the tension control roller 12 will be described based on FIG. 2 and FIG. 3, and further, referring to FIG. 1.

As shown in these figures, the tension control roller 12 has, as its driving mechanism 20, a driver 21, a position detector 22, a pressure detector 23, and a controller 24. The driver 21, the position detector 22, and the pressure detector 23 are respectively provided at both ends of the tension control roller 12. With this configuration, the tension control roller 12 controls both end positions individually, and also functions as a steering roller to adjust the position of the endless belt 13. Hereinbelow, the detailed configurations of the driver 21, the position detector 22, the pressure detector 23, and the controller 24, provided in the driving mechanism 20, will be described.

[Driver 21]

The driver 21 has two support members 21*a* to rotatably support the both ends of the tension control roller 12, shafts 21*b* respectively extended from the two support members 21*a*, and actuators 21*c* to move the respective shafts 21*b* in extending directions. The two shafts 21*b* are extended vertically to an axial direction of the driving roller 10 and the driven roller 11. With this configuration, the both ends of the tension control roller 12 move a position [x], by driving of the two actuators 21*c*, in the vertical direction to the axial direction of the driving roller 10 and the driven roller 11. Note that the position [x] is the position [x] at respective both ends of the tension control roller 12. Hereinbelow, for the sake of simplification of explanation, the position will also be simply referred to as "position [x]" of the tension control roller 12.

[Position Detector 22]

The position detector 22 is used for detection of the position [x] of the tension control roller 12 moved with the driver 21. The position detector 22 may be provided in actuator controllers of e.g. the actuators 21*c* of the two drivers 21. The position detector 22 detects the position [x] at the end of the tension control roller 12 based on driving position of the actuator 21*c*, and continuously detects the position [x].

[Pressure Detector 23]

The pressure detector 23 is a load cell to detect pressure [f] added to the tension control roller 12 with the endless belt 13 stretched around the tension control roller 12. The pressure [f] detected with the pressure detector 23 is pressure toward the inner peripheral side of the endless belt 13 in the extending direction of the shaft 21*b* of the driver 21. Further, when the length of the endless belt 13 is constant, the pressure [f] detected here depends on the position [x] of the tension control roller 12. This pressure detector 23 is attached respectively to the shafts 21*b* of the two drivers 21, to respectively detect the pressure [f] added to the ends of the tension control roller 12. Further, these pressure detectors 23 continuously detect the pressure [f].

[Controller 24]

The controller 24 is connected to the two drivers 21, the position detectors 22, and the pressure detectors 23. The controller 24 controls driving of the drivers 21 based on the values detected with the position detectors 22 and the pressure detectors 23, such that a predetermined tension [N] is applied to the endless belt 13 stretched around the tension control roller 12. Note that the predetermined tension [N] applied to the endless belt 13 is tension for rotation of the endless belt 13 with good runnability without skid or meandering. The details of the control of the driver 21 with the controller 24 will be described in the following belt driving device control method. Further, the controller 24 has an input/output controller 24*a*, a memory 24*b*, and a target pressure calculator 24*c* as follows.

—Input/Output Controller 24*a*—

The input/output controller 24*a* is connected to the above-described driver 21 (more specifically, the actuator 21*c* of the driver 21), the position detector 22, and the pressure detector 23, further, connected to the memory 24*b* and the target pressure calculator 24*c*.

The input/output controller 24*a* causes the target pressure calculator 24*c* to calculate a target pressure [F(x)] in the position [x] based on the position [x] of the tension control roller 12 detected with the position detector 22 and data stored in the memory 24*b*. Note that the target pressure [F(x)] is pressure to be added to the tension control roller 12 in the position [x] to apply the predetermined tension [N] to the endless belt 13, the length of which has been changed due to temperature change or the like, and is a value linked to the position [x].

Further, the input/output controller 24*a* causes driving of the actuators 21*c* based on the target pressure [F(x)] calculated with the target pressure calculator 24*c* and the pressure [f] detected with the pressure detector 23. Thus the input/output controller 24*a* controls driving of the belt driving device 1*a*.

This input/output controller 24*a* is a computer formed with a CPU, a ROM, and a RAM, and performs the method of controlling the belt driving device 1*a* described hereinbelow by executing a program recorded on the ROM or RAM with the CPU.

—Memory 24*b*—

The memory 24*b* is a ROM or a RAM to hold the target pressure [F(x)] linked to the position [x] of the tension control roller 12. The memory 24*b* holds, as the target pressure [F(x)] linked to the position [x] of the tension control roller 12, relational expression between the position [x] of the tension control roller 12 and the target pressure

[F(x)], or holds a table showing the linkage between the position [x] of the tension control roller 12 and the target pressure [F(x)].

Figure 4:
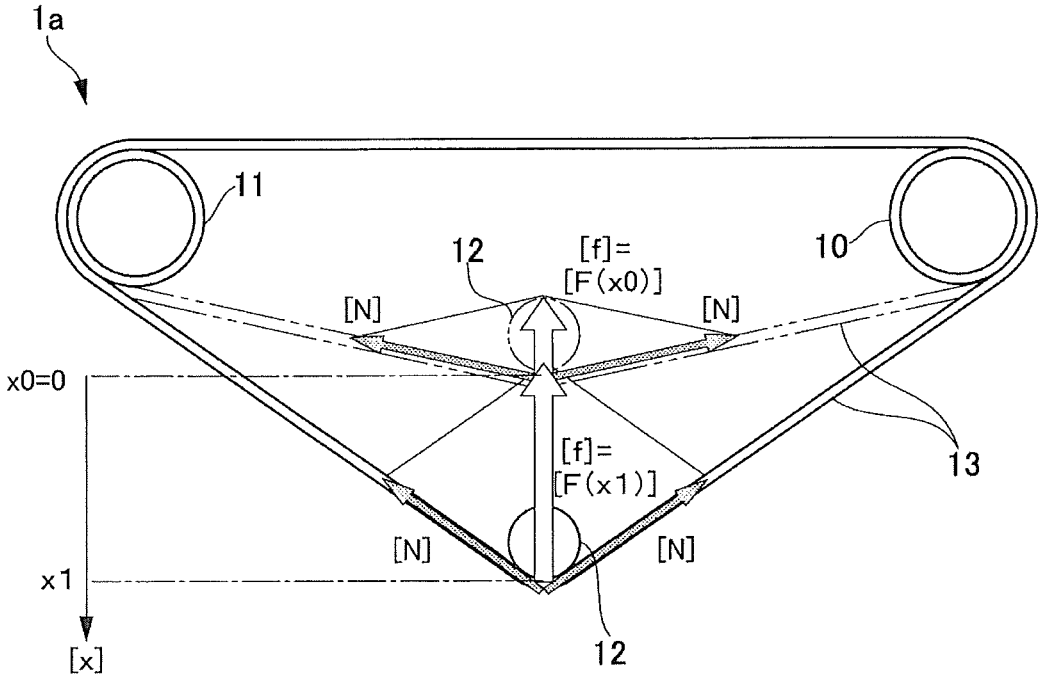
FIG. 4 is a diagram explaining the relationship between a tension control roller position [x] and a tension control roller target pressure [F(x)]

FIG. 4 is a diagram explaining the relationship between the position [x] of the tension control roller 12 and the target pressure [F(x)] of the tension control roller 12. As shown in this figure, when the endless belt 13 is expanded longer by e.g. heating, to maintain the predetermined tension [N] as a tension applied to the endless belt 13, the position [x] of the tension control roller 12 may be moved in a direction away from the driving roller 10 and the driven roller 11 by an appropriate amount.

Note that the position [x] of the tension control roller 12 is freely moved in the vertical direction to the axial direction of the driving roller 10 and the driven roller 11. Accordingly, when the endless belt 13 is expanded longer by heating, the position [x] of the tension control roller 12 is moved from the position [x]=x0 (=0) as a reference position in the vertical direction to the axial direction of the driving roller 10 and the driven roller 11 by an appropriated value, to a position [x]=x1. Thus it is possible to maintain the predetermined tension [N] as the tension applied to the endless belt 13.

Further, when the position [x] of the tension control roller 12 is changed in this manner and the predetermined tension [N] is applied to the endless belt 13, the value of the pressure [f] added to the tension control roller 12 is increased in accordance with expansion of the endless belt 13 and increase of the position [x]. That is, the pressure [f] added to the tension control roller 12 is a value represented with a function having the position [x] as a variable. Accordingly, in the position [x] of the tension control roller 12, to apply the predetermined tension [N] to the endless belt 13 having a certain length, the pressure to be applied to the tension control roller 12 is the target pressure [F(x)] as a value linked to the position [x].

Figure 5:
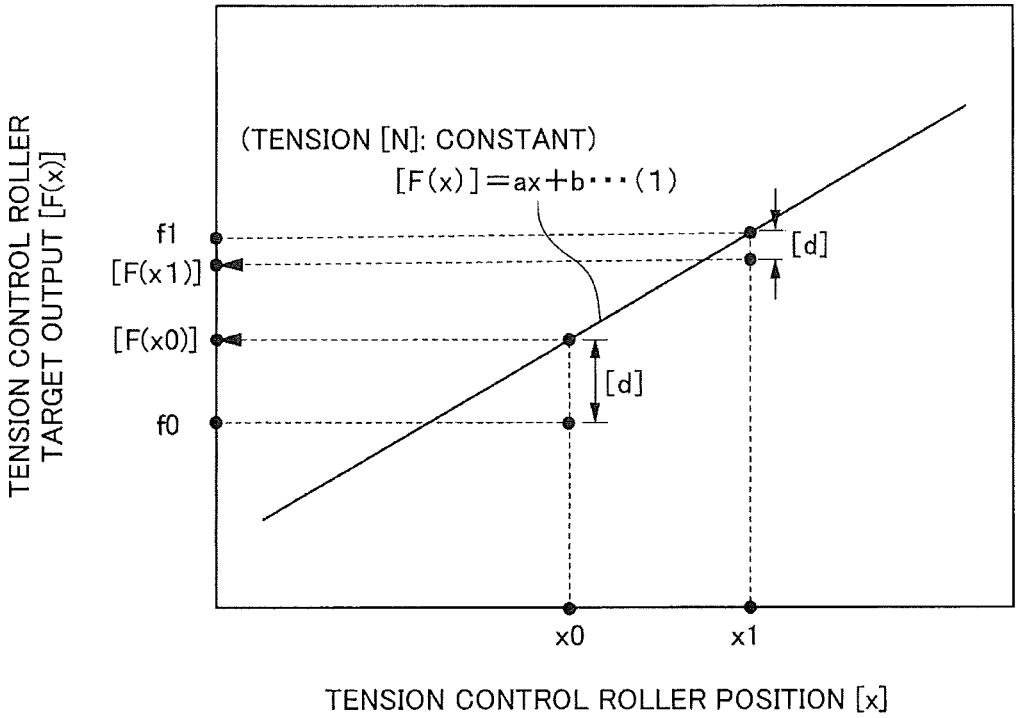
FIG. 5 is a graph showing the relationship between the tension control roller position [x] and the tension control roller target pressure [F(x)]

FIG. 5 is a graph showing a relational expression (1) between the position [x] of the tension control roller and the target pressure [F(x)] of the tension control roller to apply the predetermined tension [N] to the endless belt 13 in respective lengths. As shown in the relational expression (1), when the endless belt 13 is made of steel, the position [x] and the target pressure [F(x)] are in relationship represented by a linear function. The relational expression differs in accordance with design of the belt driving device 1*a* including material and the size of the endless belt 13. Accordingly, it is previously obtained by preliminary experiment or the like and is stored in the memory 24*b*.

—Target Pressure Calculator 24*c*—

The target pressure calculator 24*c* calculates the target pressure [F(x)] to set the tension [N] applied to the endless belt 13 in the position [x] as a predetermined value, from the position [x] of the tension control roller 12 detected with the position detector 22 and data stored in the memory 24*b*. The data stored in the memory 24*b* is the target pressure [F(x)] linked to the above-described position [x] of the tension control roller 12. The data may be the above-described relational expression, or may be the table. When the data stored in the memory 24*b* is a table, the target pressure calculator 24*c* compares the position [x] of the tension control roller 12 detected with the position detector 22 with the table stored in the memory 24*b*, and selects a target pressure [F(x)].

<<Belt Driving Device Control Method>>

Figure 6:
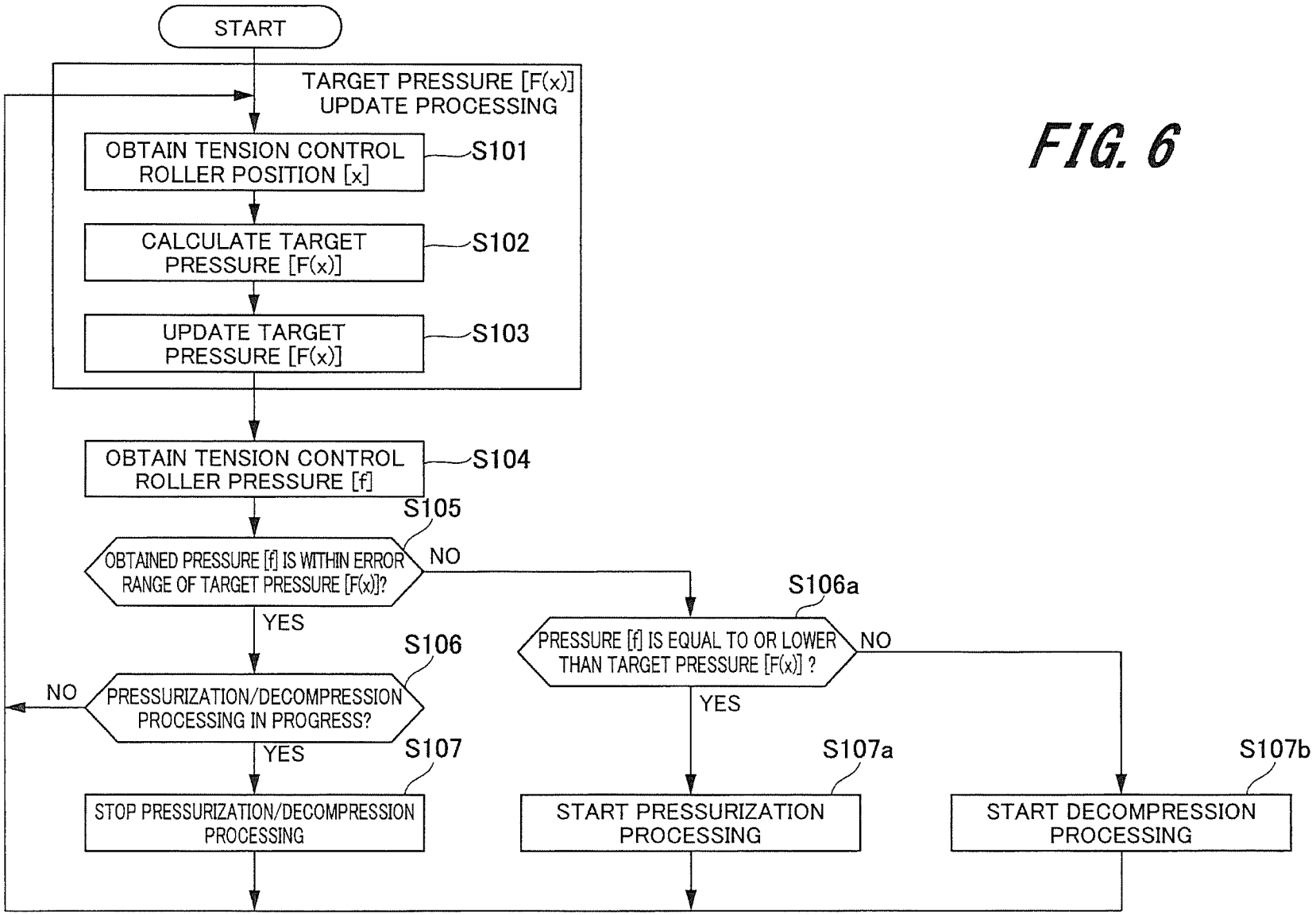
FIG. 6 is a flowchart showing a belt driving device control method according to the embodiment.

FIG. 6 is a flowchart showing a belt driving device control method according to the embodiment. The belt driving device control method shown in the flowchart is the method of controlling the belt driving device 1*a* performed with the controller 24 of the above-described driving mechanism 20. Hereinbelow, referring to the functional block diagram of FIG. 3 and the graph of FIG. 5, the procedure of the method of controlling the belt driving device 1*a* will be described along with the flowchart of FIG. 6. Note that the processing shown in the flowchart of FIG. 6 is started when the power source of e.g. the belt driving device 1*a* or the power source of an image forming apparatus having the belt driving device 1*a* is turned on, as a trigger.

[Step S101]

At step S101, the input/output controller 24*a* obtains the position [x] of the tension control roller 12 detected with the position detector 22. As the position [x] obtained immediately after the start of the processing is, e.g., an initial position [x]=x0 (=0).

[Step S102]

At step S102, the input/output controller 24*a* calculates the target pressure [F(x)] from the relational expression (1) stored in the memory 24*b* and the position [x] obtained at step S101, by the control of the target pressure calculator 24*c*. The target pressure [F(x)] is pressure to be added to the tension control roller 12 in the position [x] so as to apply the predetermined tension [N] to the endless belt 13. For example, the target pressure [F(x0)] corresponding to the initial position [x]=x0 immediately after the start of the processing is calculated here.

[Step S103]

Next, at step S103, the input/output controller 24*a* updates the stored target pressure [F(x)] to the target pressure [F(x)] calculated at step S102 (e.g. [F(x0)]).

[Step S104]

At step S104, the input/output controller 24*a* obtains the pressure [f] of the tension control roller 12 detected with the pressure detector 23. As the pressure [f] obtained immediately after the start of the processing, e.g., pressure [f]=f0 holds.

[Step S105]

At step S105, the input/output controller 24*a* compares the pressure [f] obtained at step S104 with the target pressure [F(x)] updated at step S103, to determine whether or not a difference [d] between the obtained pressure [f](e.g. pressure [f]=f0) and the target pressure [F(x)] (e.g. [F(x0)] is within an error range. Note that the error is a previously set value as a range not to influence the running of the endless belt 13.

When the input/output controller 24*a* determines that the difference [d] between the obtained pressure [f] and the target pressure [F(x)] is within the error range (YES), it proceeds to step S106. On the other hand, when the input/output controller 24*a* determines that the difference is not within the error range (NO), it proceeds to step S106*a*.

[Step S106]

At step S106, the input/output controller 24*a* determines whether or not pressurization/decompression processing is in progress at present, based on the control state of the driver 21. The "pressurization/decompression processing is in progress" means that processing to change the pressure added from the endless belt 13 to the tension control roller 12 by change of the position [x] of the tension control roller 12 with the driver 21 is being performed. When the input/output controller 24*a* determines that the pressurization/decompression processing is in progress (YES), it proceeds to step S107. On the other hand, when the input/output controller 24*a* determines that the pressurization/decompression processing is not in progress (NO), it returns to step S101.

[Step S107]

At step S107, the input/output controller 24*a* stops the pressurization/decompression processing by the control of the driver 21. In this case, it may stop the position [x] of the tension control roller 12 with the driver 21. Thereafter, it returns to step S101.

[Step 106*a*]

On the other hand, at step S106*a*, the input/output controller 24*a* determines whether or not the pressure [f] obtained at step S104 is equal to or lower than the target pressure [F(x)] updated at step S103. Then, when the input/output controller 24*a* determines that the pressure [f] is equal to or lower than the target pressure [F(x)] (YES), it proceeds to step S107*a*. On the other hand, when the input/output controller 24*a* determines that the pressure [f] is not equal to or lower than the target pressure [F(x)] (NO), it proceeds to step S107*b*.

Figure 7:
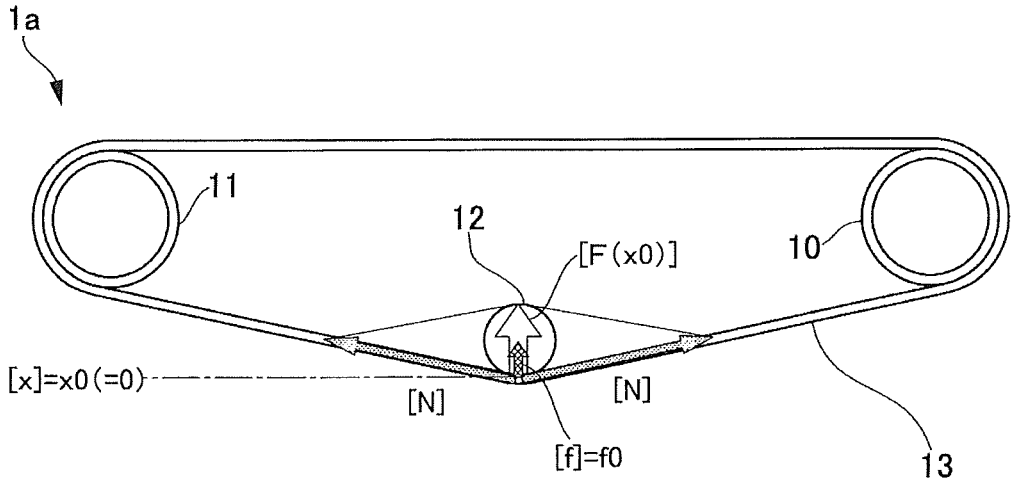
FIG. 7 is a first diagram explaining the belt driving device control method according to the embodiment.

FIG. 7 is a first diagram explaining the belt driving device control method according to the embodiment. As shown in this figure, at step S106*a*, when it is determined that the pressure [f] is equal to or lower than the target pressure [F(x)] (YES), the obtained pressure [f] (=f0) is lower than the target pressure [F(x)] (=[F(x0)]). Further, its difference [d] is greater than the previously set error range.

[Step S107*a*]

Then at step S107*a*, the input/output controller 24*a* starts pressurization processing by the control of the driver 21. The pressurization processing is processing to move the position [x] of the tension control roller 12 in the direction away from the driving roller 10 and the driven roller 11, so as to increase the pressure added with the endless belt 13 to the tension control roller 12, and is processing to bring the pressure [f] closer to the target pressure [F(x)].

At this time, when the pressurization processing is already performed, the pressurization processing is continued. Further, when decompression processing is performed, the decompression processing is stopped and the pressurization processing is started.

The speed of the pressurization processing, i.e. the moving speed of the position [x] of the tension control roller 12 is set such that the difference [d] between the target pressure [F(x)] updated at step S103 and the pressure [f] obtained at step S104 becomes within the error range as soon as possible. Further, after the end of this starting processing, the process returns to step S101.

[Step S107*b*]

On the other hand, at step S107*b*, the input/output controller 24*a* starts decompression processing by the control of the driver 21. The decompression processing is processing to move the position [x] of the tension control roller 12 in a direction approaching the driving roller 10 and the driven roller 11, so as to reduce the pressure added with the endless belt 13 to the tension control roller 12, and is processing to bring the pressure [f] closer to the target pressure [F(x)].

At this time, when the decompression processing is already performed, the decompression processing is continued. Further, when the pressurization processing is performed, the pressurization processing is stopped, and the decompression processing is started.

The speed of this decompression processing, i.e., the moving speed of the position [x] of the tension control roller 12 is set such that the difference between the target pressure [F(x)] updated at step S103 and the pressure [f] obtained at step S104 becomes within the error range as soon as possible. Further, after the end of this start processing, the process returns to step S101.

Figure 8:
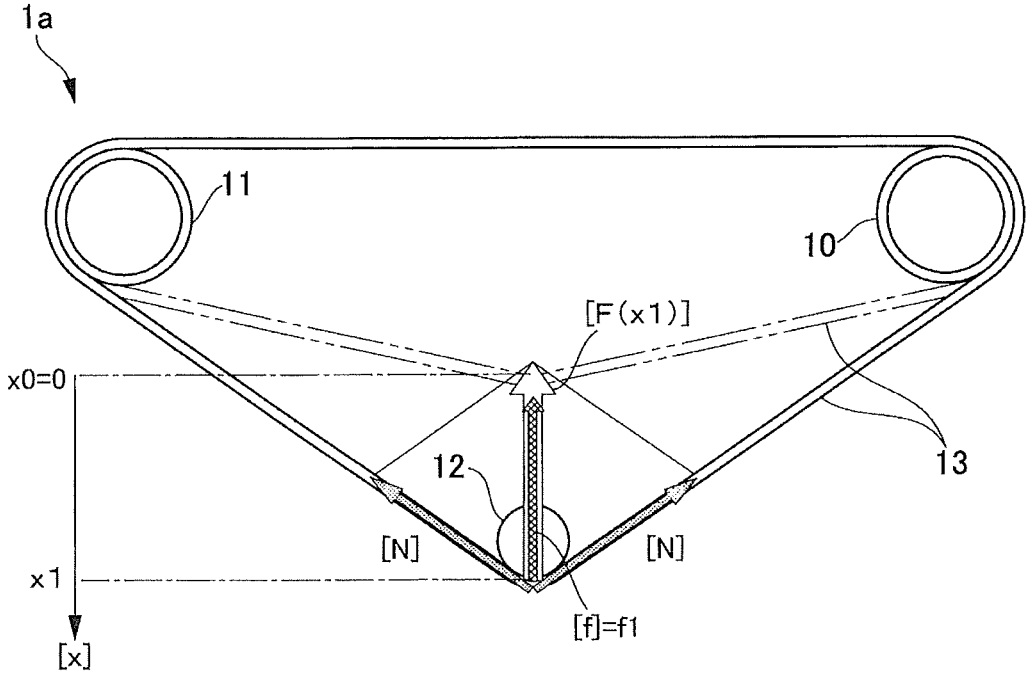
FIG. 8 is a second diagram explaining the belt driving device control method according to the embodiment.

FIG. 8 is a second diagram explaining the belt driving device control method according to the embodiment. As shown in this figure and FIG. 5, in the repeated processing at and after step S101, in correspondence with the position [x]=x1 obtained at the next step S101, a new target pressure [F(x1)] is calculated at the next step S102. Further, at step S104, a new pressure [f]=f1 is obtained. As shown in the figure, the newly calculated target pressure [F(x1)] may be lower, or may be higher, than the new pressure [f]=f1. Then the pressurization processing or the decompression processing by the control of the driver 21 is continued until it is determined at step S105 that the difference[d] between these pressures is within the error range, so as to converge the tension applied to the endless belt 13 to a predetermined tension [F(x)].

Effects of the Embodiment

The above-described belt driving device 1*a* according to the embodiment has a configuration that the pressure [f] added to the tension control roller 12 is converged to the target pressure [F(x)] to apply the predetermined tension [N] to the endless belt 13 with the position [x] of the tension control roller 12, and by feed-back of the pressure [f] added from the endless belt 13 to tension control roller 12. Accordingly, it is possible to effectively converge the tension of the endless belt 13 to the predetermined tension [N] in correspondence with expansion and contraction of the endless belt 13, to further improve the running performance of the endless belt 13. With this configuration, it is possible to infallibly prevent skid or meandering of the endless belt 13 expanded longer by heating.

Note that the smaller the angle with the tension control roller 12 as a vertex in the extending direction of the endless belt 13 is, the greater the change of the target pressure [F(x)] corresponding to the change of the position [x] of the tension control roller 12 is. Accordingly, by downsizing of the device structure, it is possible to notably obtain the effects of the above-described embodiment in accordance with reduction of the angle with tension control roller 12 as a vertex in the extending direction of the endless belt 13. Further, it is possible to control the runnability of the endless belt 13 with higher precision.

Further, by the above-described feed-back, the position [x] of the tension control roller 12 is changed as needed by moving the tension control roller 12 at a predetermined speed. Accordingly, it is possible to quickly converge the pressure [f] added to the tension control roller 12 to the target pressure [F(x)]. With this configuration, it is possible to stabilize the runnability of the endless belt 13 at a high speed.

Further, by individually moving the both ends of the tension control roller 12, it is possible to control the runnability of the endless belt 13 with higher precision.

Further, according to the image forming apparatus 1 having the above-described belt driving device 1*a*, it is possible to improve image forming precision.

<<Modifications>>

In the above-described embodiment, one relational expression (or table) is stored in the memory 24*b*. However, it may be configured such that plural relational expressions (or tables) are stored in the memory 24*b*, the input/output controller 24*a* selects an appropriate relational expression from the plural relational expressions in accordance with use status of the endless belt 13, and uses the selected relational expression in the calculation of the target pressure [F(x)] at step S102. Note that the plural relational expressions (or tables) are previously prepared.

As an example, in a case where the belt driving device 1*a* is used in the image forming apparatus 1, the plural relational expressions (or tables) are prepared in correspondence with the number of images formed with the image forming apparatus 1. With this configuration, when a paper sheet is used as the recording medium P, it is possible to control the runnability of the endless belt 13 considering that the endless belt 13 becomes slippery due attachment of paper powder to the endless belt 13.

Further, in the above-described embodiment, the position [x] of the tension control roller 12 is moved at a predetermined speed upon start of the pressurization processing at step S107*a* and upon start of the decompression processing at step S107*b*. However, it may be configured such that at these steps, the position [x] of the tension control roller 12 is moved by a predetermined amount. In this case, step S106 and step S107 are omitted. When it is determined as (YES) at step S105, the process returns to step S101.

Further, in the above-described embodiment, the roller provided in approximately parallel to the driving roller 10 and the driven roller 11, between the driving roller 10 and the driven roller 11, is the tension control roller 12. However, it may be configured such that the roller provided in approximately parallel to the driving roller 10 and the driven roller 11, between the driving roller 10 and the driven roller 11, is merely a driven roller or a steering roller, and the driving mechanism 20 is provided in the shown driven roller 11, as a tension control roller.

Further, in the above-described embodiment, the image forming apparatus 1 is an ink-jet type apparatus, however, the present invention is not limited to this type. For example, the invention is also applicable to an electrophotographic type image forming apparatus using toner. In this case, the belt driving device 1*a* is used as an intermediate transfer belt to hold a toner image, and a developing device is provided oppositely to the outer peripheral surface of the endless belt 13. Further, the outer peripheral surface of the endless belt 13 is used as a toner image holding surface to hold a toner image formed with toner supplied with the developing device. In this case, it is also possible to obtain a similar effect to that obtained in the above-described embodiment.

Although embodiments of the present invention have been described and illustrated in detail, the disclosed embodiments are made for purposes of illustration and example only and not limitation. The scope of the present invention should be interpreted by terms of the appended claims.

REFERENCE SIGNS LIST

1 . . . image forming apparatus (image forming part)
1*a* . . . belt driving device
1*b* . . . ink supply device
10 . . . driving roller
11 . . . driven roller
12 . . . tension control roller
13 . . . endless belt
21 . . . driver
22 . . . position detector
23 . . . pressure detector
24 . . . controller
24*b* . . . memory
24*c* . . . target pressure calculator
P . . . recording medium
[N] . . . predetermined tension
[f] . . . pressure added to tension control roller
[F(x)] . . . target pressure
[x] . . . tension control roller position

What is claimed is:

1. An image forming apparatus in which an image forming part is provided with a belt driving device, the belt driving device comprising:

a plurality of rollers, the plurality of rollers including a driving roller, a driven roller, and a tension control roller;

an endless belt stretched around the plurality of rollers;

a driver configured to control tension applied to the endless belt and configured to move a position of the tension control roller in a vertical direction to axes of the driving roller and the driven roller, the driver comprising two support members configured to rotatably support each end of the tension control roller;

a position detector configured to detect the position of the tension control roller;

a pressure detector configured to detect pressure applied with the endless belt to the tension control roller; and a controller configured to control movement of the tension control roller with the driver, wherein, to set the tension applied to the endless belt as a predetermined value, the controller controls the driver to bring the pressure detected with the pressure detector closer to a target pressure to be added to the tension control roller in the position of the tension control roller detected with the position detector.

2. The image forming apparatus according to claim 1, wherein the controller has a memory to hold the target pressure linked to the position of the tension control roller.

3. The image forming apparatus according to claim 1, wherein the controller has a target pressure calculator configured to calculate the target pressure based on the position of the tension control roller detected with the position detector, and wherein the controller is configured to control the driver so as to reduce a difference between the calculated target pressure and the pressure detected with the pressure detector.

4. The image forming apparatus according to claim 1, wherein the controller moves the tension control roller with the driver at a predetermined speed, and when the difference between the target pressure and the pressure detected with the pressure detector is equal to or lower than a predetermined value, stops the movement of the tension control roller with the driver.

5. The image forming apparatus according to claim 1, wherein the driver, the position detector, and the pressure detector are respectively provided in each of the ends of the tension control roller, and wherein the controller individually controls driving of the respective drivers in each of the ends of the tension control roller.

6. The image forming apparatus according to claim 1 further comprising an ink supply device provided oppositely to an outer peripheral surface of the endless belt, wherein the outer peripheral surface of the endless belt is used as a conveyance surface for the recording medium, on which an ink image, formed of ink supplied with the ink supply device, is formed.

7. The image forming apparatus according to claim 1 further comprising:

a developing device provided oppositely to an outer peripheral surface of the endless belt, wherein the outer peripheral surface of the endless belt is used as a holding surface for a toner image formed of toner supplied with the developing device.

8. A belt driving device, the belt driving device comprising:

a plurality of rollers, the plurality of rollers including a driving roller, a driven roller, and a tension roller;

an endless belt stretched around the plurality of rollers;

a driver configured to control tension applied to the endless belt and configured to move a position of the tension control roller in a vertical direction to axes of the driving roller and the driven roller, the driver comprising two support members configured to rotatably support each end of the tension control roller;

a position detector configured to detect the position of the tension control roller;

a pressure detector configured to detect pressure applied to the tension control roller with the endless belt; and a controller configured to control movement of the tension control roller with the driver, wherein, to set the tension applied to the endless belt as a predetermined value, the controller controls the driver to bring the pressure detected with the pressure detector closer to a target pressure to be added to the tension control roller in the position of the tension control roller detected with the position detector.

9. The belt drive system according to claim 8, wherein the controller has a memory to hold the target pressure linked to the position of the tension control roller.

10. The belt drive system according to claim 8, wherein the controller has a target pressure calculator configured to calculate the target pressure based on the position of the tension control roller detected with the position detector;

and the controller is configured to control the driver so as to reduce a difference between the calculated target pressure and the pressure detected with the pressure detector.

11. The belt drive system according to claim 8, wherein the controller moves the tension control roller with the driver at a predetermined speed, and when the difference between the target pressure and the pressure detected with the pressure detector is equal to or lower than a predetermined value, stops the movement of the tension control roller with the driver.

12. The belt drive system according to claim 8, wherein the driver, the position detector, and the pressure detector are respectively provided in each of the ends of the tension control roller, and wherein the controller individually controls driving of the respective drivers in each of the ends of the tension control roller.

13. A method of controlling a belt driving device having a plurality of rollers, the plurality of rollers including a driving roller, a driven roller and tension roller, an endless belt stretched around the plurality of rollers, and a driver configured to control tension applied to the endless belt and configured to move a position of the tension control roller in a vertical direction to axes of the driving roller and the driven roller, the method comprising:

rotatably supporting each end of the tension control roller with a support member;

detecting the position of the tension control roller with a position detector;

detecting pressure applied from the endless belt to the tension control roller with the pressure detector; and controlling, to set the tension applied to the endless belt as a predetermined value, the driver to bring the pressure detected with the pressure detector closer to a target pressure to be added to the tension control roller in the position of the tension control roller detected with the position detector, with the controller.

14. The method according to claim 13, wherein the controller has a memory to hold the target pressure linked to the position of the tension control roller.

15. The method according to claim 13, wherein the controller has a target pressure calculator, the method further comprising:

calculating the target pressure based on the position of the tension control roller detected with the position detector;

controlling the driver so as to reduce a difference between the calculated target pressure and the pressure detected with the pressure detector.

16. The method according to claim 13, comprising:

moving the tension control roller with the driver at a predetermined speed; and when the difference between the target pressure and the pressure detected with the pressure detector is equal to or lower than a predetermined value, stopping the movement of the tension control roller with the driver.

17. The method according to claim 13, wherein the driver, the position detector, and the pressure detector are respectively provided in each of the ends of the tension control roller, and wherein the method further comprises:

individually control driving of the respective drivers in each of the ends of the tension control roller.

18. The method according to claim 13, further comprising an ink supply device provided oppositely to an outer peripheral surface of the endless belt, and wherein the method comprises:

using the outer peripheral surface of the endless belt as a conveyance surface for the recording medium, on which an ink image, formed of ink supplied with the ink supply device, is formed.

19. The method according to claim 13, further comprising:

a developing device provided oppositely to an outer peripheral surface of the endless belt; and wherein the method comprises:

using the outer peripheral surface of the endless belt as a holding surface for a toner image formed of toner supplied with the developing device.

* * * * *